US008757407B2

(12) United States Patent
Konefal et al.

(10) Patent No.: US 8,757,407 B2
(45) Date of Patent: Jun. 24, 2014

(54) CLOSURE AND CONTAINER PACKAGE WITH CHILD-RESISTANT AND NON-CHILD-RESISTANT MODES OF OPERATION

(75) Inventors: Robert S. Konefal, Wilton, NH (US); Steven R. Wolfe, Maumee, OH (US); John M. Shingle, Perrysburg, OH (US)

(73) Assignee: Rexam Prescription Products Inc., Perrysburg, OH (US)

( * ) Notice: Subject to any disclaimer, the term of this patent is extended or adjusted under 35 U.S.C. 154(b) by 1837 days.

(21) Appl. No.: 11/443,329

(22) Filed: May 30, 2006

(65) Prior Publication Data

US 2006/0213861 A1 Sep. 28, 2006

Related U.S. Application Data

(62) Division of application No. 10/684,724, filed on Oct. 13, 2003, now abandoned.

(51) Int. Cl.
*B65D 41/06* (2006.01)
*B65D 55/02* (2006.01)

(52) U.S. Cl.
USPC ..... 215/222; 215/332; 215/43; 215/228

(58) Field of Classification Search
USPC ..... 215/43, 222, 228, 332; 220/293, 298, 220/300, 301
See application file for complete search history.

(56) References Cited

U.S. PATENT DOCUMENTS

| | | | |
|---|---|---|---|
| 2,447,166 | A | 8/1948 | Daffer |
| 3,441,161 | A | 4/1969 | Van Baarn |
| 3,559,832 | A | 2/1971 | Balducci |
| 3,612,324 | A | 10/1971 | Malick |
| 3,685,676 | A | 8/1972 | Gach et al. |

(Continued)

FOREIGN PATENT DOCUMENTS

| | | |
|---|---|---|
| DE | 3605963 | 8/1987 |
| GB | 2157661 | 10/1985 |
| GB | 2175289 | 11/1986 |
| GB | 2192385 | 1/1988 |

*Primary Examiner* — Fenn Mathew
*Assistant Examiner* — James N Smalley
(74) *Attorney, Agent, or Firm* — Reising Ethington PC

(57) ABSTRACT

A package that has both child-resistant and non-child-resistant modes of operation. A container has an end with an open mouth surrounded by a container wall with a central axis and at least one first lock element extending radially outwardly from the wall. A closure includes an annular base wall having inner and outer peripheral edges. A cylindrical skirt extends from the outer peripheral edge of the base wall, and at least one second lock element is disposed on the skirt. A projection extends axially from the inner peripheral edge of the base wall in a direction opposite from the skirt. The projection has an annular sidewall spaced radially inwardly from the outer peripheral edge of the skirt. The closure is adapted to be secured to the container in a child-resistant mode of operation with the second lock element on the skirt releasably engaged with the first lock element on the container wall, and with the inner peripheral edge of the base wall in resilient engagement with the outer surface of the container wall to bias the lock elements in engagement with each other and to seal the package. The closure is adapted to be inverted and secured to the container in a non-child-resistant mode of operation with the annular sidewall of the projection received in plug-sealing engagement within the container mouth.

8 Claims, 11 Drawing Sheets

(56) References Cited

U.S. PATENT DOCUMENTS

| | | | | | |
|---|---|---|---|---|---|
| 3,794,200 | A | | 2/1974 | Marks | |
| 3,809,276 | A | | 5/1974 | Landen | |
| 3,865,267 | A | | 2/1975 | Morris | |
| 3,880,313 | A | | 4/1975 | Akers | |
| 3,880,314 | A | | 4/1975 | Akers | |
| 3,923,181 | A | * | 12/1975 | Libit | 215/224 |
| 3,955,696 | A | | 5/1976 | Finke | |
| 3,986,626 | A | | 10/1976 | Montgomery | |
| 4,008,820 | A | | 2/1977 | Ruetz | |
| 4,091,948 | A | | 5/1978 | Northup | |
| 4,094,429 | A | | 6/1978 | Urbin | |
| 4,095,718 | A | * | 6/1978 | Kong | 215/223 |
| RE29,779 | E | | 9/1978 | Morris | |
| 4,128,184 | A | | 12/1978 | Northup | |
| 4,153,172 | A | * | 5/1979 | Bialobrzeski | 215/209 |
| 4,223,795 | A | | 9/1980 | Akers | |
| 4,322,012 | A | | 3/1982 | Conti | |
| 4,353,475 | A | | 10/1982 | Kachur et al. | |
| 4,383,619 | A | | 5/1983 | Mumford et al. | |
| 4,397,397 | A | | 8/1983 | Herr | |
| 4,399,920 | A | | 8/1983 | Swartzbaugh et al. | |
| 4,452,364 | A | | 6/1984 | Kay | |
| 4,526,281 | A | | 7/1985 | Herr | |
| 4,588,097 | A | | 5/1986 | Hauser | |
| 4,598,835 | A | | 7/1986 | Brownbill | |
| 4,623,070 | A | | 11/1986 | Nishikawa | |
| 4,627,547 | A | | 12/1986 | Cooke | |
| 4,674,644 | A | | 6/1987 | Jacobs | |
| 4,729,487 | A | | 3/1988 | Wright | |
| 4,747,501 | A | | 5/1988 | Greaves | |
| 4,823,967 | A | | 4/1989 | Thompson | |
| 5,117,995 | A | | 6/1992 | Kau | |
| 5,161,706 | A | | 11/1992 | Weinstein | |
| 5,238,130 | A | | 8/1993 | Marques et al. | |
| 5,275,287 | A | | 1/1994 | Thompson | |
| 5,394,999 | A | | 3/1995 | Krall | |
| 5,449,078 | A | | 9/1995 | Akers | |
| 5,460,283 | A | | 10/1995 | Macartney et al. | |
| 5,464,110 | A | | 11/1995 | Heyworth | |
| 5,529,202 | A | | 6/1996 | Shamis | |
| 5,564,580 | A | | 10/1996 | Hamilton et al. | |
| 5,579,934 | A | | 12/1996 | Buono | |
| 5,769,252 | A | | 6/1998 | Volpe | |
| 5,829,609 | A | | 11/1998 | Beck | |
| 5,899,348 | A | | 5/1999 | Konefal et al. | |
| 5,924,588 | A | | 7/1999 | Brennan | |
| 5,938,055 | A | | 8/1999 | Philips et al. | |
| 5,947,622 | A | | 9/1999 | Akyildiz et al. | |
| 6,003,700 | A | | 12/1999 | Julian et al. | |
| 6,056,136 | A | | 5/2000 | Taber et al. | |
| 6,082,565 | A | | 7/2000 | Harrold | |
| 6,102,223 | A | | 8/2000 | Montgomery | |
| 6,149,022 | A | | 11/2000 | Akyildiz et al. | |
| 6,161,711 | A | | 12/2000 | Miceli et al. | |
| 6,202,876 | B1 | | 3/2001 | DeJonge | |
| 6,357,615 | B1 | | 3/2002 | Herr | |
| 6,371,316 | B1 | | 4/2002 | Herr et al. | |
| 6,378,713 | B2 | | 4/2002 | Montgomery | |
| 6,439,409 | B1 | | 8/2002 | Dressel et al. | |
| 6,446,823 | B2 | | 9/2002 | Miceli et al. | |
| 6,477,823 | B1 | | 11/2002 | Kitterman et al. | |
| 6,523,709 | B2 | | 2/2003 | Miceli et al. | |
| 2001/0019033 | A1 | | 9/2001 | Montgomery | |
| 2001/0035388 | A1 | | 11/2001 | Miceli et al. | |
| 2002/0027120 | A1 | | 3/2002 | Miceli et al. | |
| 2002/0043512 | A1 | | 4/2002 | Sandor et al. | |
| 2002/0084239 | A1 | | 7/2002 | Dressel et al. | |
| 2002/0130101 | A1 | | 9/2002 | Ekkert | |
| 2002/0162817 | A1 | | 11/2002 | Vassallo | |
| 2002/0195412 | A1 | | 12/2002 | Miceli et al. | |

* cited by examiner

CLOSURE AND CONTAINER PACKAGE WITH CHILD-RESISTANT AND NON-CHILD-RESISTANT MODES OF OPERATION

This application is a division of application Ser. No. 10/684,724 filed Oct. 13, 2003 now abandoned.

The present invention relates to child-resistant closure and container packages, such as prescription packages for example, to closures and containers for such packages, and to methods of making such packages.

Reference is made to U.S. application Ser. Nos. 10/388,293, 10/386,192 and 10/378,441 assigned to the assignee of the present application.

BACKGROUND AND SUMMARY OF THE INVENTION

U.S. Pat. Nos. 4,057,159, 4,059,198 and 4,485,932 disclose child-resistant closure and container prescription packages that include a container or vial, a closure, and a spring/seal disk arrangement disposed between the closure and the container. The closure has lugs on an inside surface of a skirt that cooperate with external locking notches or pockets on projections around the mouth of the container for securing the closure to the container. An internal abutment on the closure cooperates with the spring/seal disk(s) to urge the closure away from the container so that the lugs are resiliently captured within the notches. When it is desired to remove the closure, the closure is pushed toward the container so that the lugs clear the notches, and then turned counterclockwise. When the closure is assembled to the container, the lugs cam beneath surfaces on the projections against the force of the spring seal disk(s) until the lugs snap into the notches on the projections.

Although the closure and container packages disclosed in the noted patents have enjoyed substantial commercial acceptance and success, improvements remain desirable. For example, it can be difficult for adults with impaired dexterity to push and twist the closure with respect to the container to open the package for access to the contents. One general object of the present invention to provide a closure and container package, a closure and a container for use in such a package, and/or a method of making such a package, in which the closure can be secured to the container in a child-resistant mode of operation as described above, and in a non-child-resistant mode of operation for use by adults with impaired manual dexterity, for example, when child-resistance is not needed. It is another and more specific object of the present invention to provide a package, a container, a closure and/or a method of the described character that achieves the non-child-resistant mode of operation with little additional material, tooling or labor cost as compared with conventional child-resistant packages as described in the noted patents.

Another general object of the present invention is to provide a two-piece package of the subject type—i.e., a closure and a container without a separate spring element—in which the spring forces for holding the closure on the container are provided by resilient flexure of either or both of the closure and the container. In furtherance of this objective, another object of the invention is to provide a package in which the closure and container are economical to manufacture. A further objective is to provide a package that is readily suited to automated packaging—i.e., is automation friendly.

The present invention embodies a number of aspects that can be implemented separately from or, more preferably, in combination with each other.

A child-resistant package in accordance with a first aspect of the present invention includes a container having a wall surrounding an open mouth, a plurality of external projections extending radially outwardly from the container wall at positions spaced from the mouth, notches on undersides of the projections, and an external surface on the container wall that slopes radially inwardly and axially upwardly between the projections and the mouth. A closure has an annular base wall with an internal peripheral edge, an external a peripheral skirt and a plurality of internal lugs on the skirt. The internal peripheral edge of the base wall is engagable with the sloping external wall surface of the container between the projections and the mouth for both sealing the package and resiliently urging the closure lugs into the notches of the projections. The holding forces can be supplied by resilient flexure of the closure or the container, or both. A two-piece package in accordance with this aspect of the invention thus eliminates any need for additional spring/seal disk elements in the assembly.

A package in accordance with another aspect of the present invention has both child-resistant and non-child-resistant modes of operation. A container has an end with an open mouth surrounded by a container wall with a central axis and at least one first lock element extending radially outwardly from the wall. A closure includes an annular base wall having inner and outer peripheral edges. A cylindrical skirt extends from the outer peripheral edge of the base wall, and at least one second lock element is disposed on the skirt. A projection extends axially from the inner peripheral edge of the base wall in a direction opposite from the skirt. The projection has an annular sidewall spaced radially inwardly from the outer peripheral edge of the skirt. The closure is adapted to be secured to the container in a child-resistant mode of operation with the at least one second lock element on the skirt releasably engaged with the at least one first lock element on the container wall, and with the inner peripheral edge of the base wall in resilient engagement with the outer surface of the container wall to bias the lock elements in engagement with each other and to seal the package. The closure is adapted to be inverted and secured to the container in a non-child-resistant mode of operation with the annular sidewall of the dome received in plug-sealing engagement within the container mouth.

In the preferred embodiments of the invention, the annular base wall of the closure is flat and lies in a plane between the inner and outer peripheral edges of the base wall. The inner and outer peripheral edges of the base wall preferably are circular and concentric. In some embodiments of the invention, the portion of the container wall between the lock element(s) on the container wall and the container mouth tapers in radial thickness. This container wall portion is flexible radially inwardly upon engagement with the inner peripheral edge of the base wall in the child-resistant mode of operation, and radially outwardly upon engagement with the closure projection in the non-child-resistant mode of operation. In one embodiment, an undercut on the inner surface of the container enhances the flexibility of the container end. In other embodiments of the invention, an external stiffening bead or rib surrounds the container mouth to prevent flexure of the container wall portion surrounding the mouth, and the closure itself is resiliently flexible radially outwardly in the child-resistant mode of operation for sealing the package and biasing the locking elements in engagement with each other. In some embodiments of the invention, an external bead on the closure projection engages an internal bead on the container wall to secure the closure to the container in the non-child-resistant mode of operation. In other embodiments of the invention, an external wall on the closure surrounds the projection and externally engages the container to secure the closure to the container in the non-child-resistant mode of operation.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

FIGS. 1-3 and 10-11 illustrate a package 30 in accordance with one presently preferred embodiment of the invention. Package 30 includes a container or vial 32 and a closure 34 secured to container 32 either in a child-resistant mode of operation illustrated in FIGS. 1-3, or in a non-child-resistant mode of operation illustrated in FIGS. 10-11.

Figure 3:
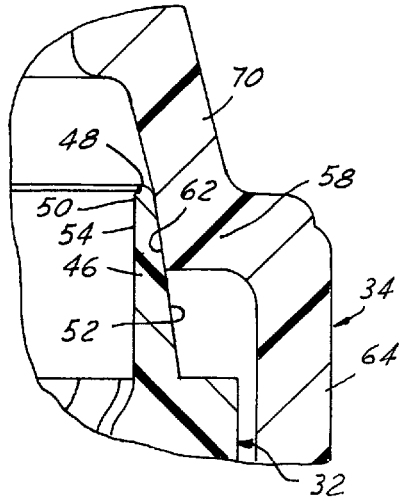
FIG. 3 is a fragmentary view on an enlarged scale of the portion of FIG. 2 within the area 3.
Figure 4:
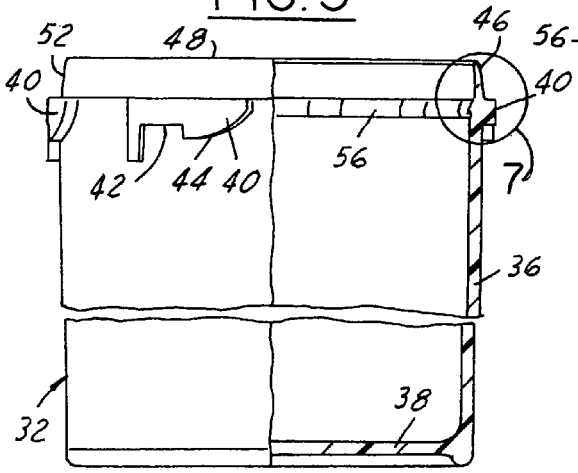
FIG. 4 is a fragmentary partially sectional elevational view of the container in the package of FIGS. 1-3.
Figure 7:
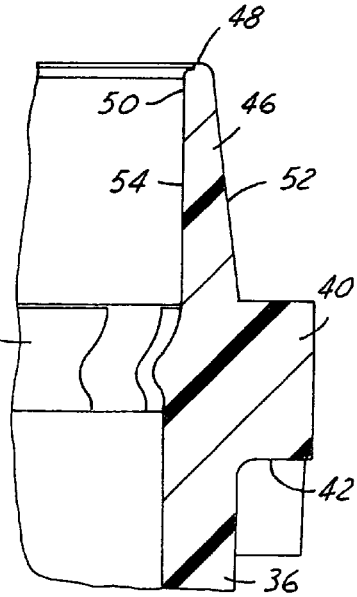
FIG. 7 is a fragmentary sectional view of the portion of FIG. 4 within the area 7.
Figure 6:
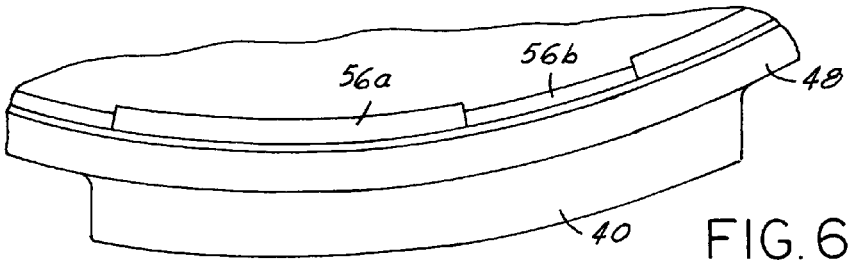
FIG. 6 is a fragmentary view on an enlarged scale of the portion of FIG. 5 within the area 6.

Referring in particular to FIGS. 4-7, container 32 includes a sidewall 36 and a bottom wall 38. A circumferential array of projections 40 extend radially outwardly near the upper end of sidewall 38. Each projection 40 has a downwardly facing notch or pocket 42 for receiving locking lugs on the closure in a child-resistant mode of operation, and a cam surface 44 for camming the lugs into notches 42. Projections 40 lie in a plane perpendicular to the axis of the container. A portion 46 of container wall 36 extends upwardly from the plane of projections 40. As best seen in FIG. 7, the portion 46 of container wall 36 that extends upwardly from projections 40 preferably tapers narrowingly in radial thickness toward the upper end or edge 48 that surrounds the mouth 50 of the container. The radially outwardly facing surface 52 of wall portion 46 preferably is conical, while the inner surface 54 preferably is substantially cylindrical (ignoring draft angle). (Directional words such as "upwardly" and "downwardly" are employed by way of description and not limitation with respect to the upright orientation of the container illustrated in FIGS. 1-4, 7 and 10-11. Directional words such as "radial" and "axial" are employed by way of description and not limitation with respect to the central axis of the closure or container as appropriate.) A circumferential bead 56 extends radially inwardly from inner surface 54 of the container wall. Bead 56 is circumferentially segmented in the embodiment of FIGS. 4-7, comprising circumferentially spaced axially and radially enlarged segments 56*a* separated from each other by smaller segments 56*b*. Bead 56 is spaced from upper end 48 in the embodiment of FIGS. 1-11, being disposed radially inwardly of projections 40 as best seen in FIGS. 4 and 7.

Figure 8:
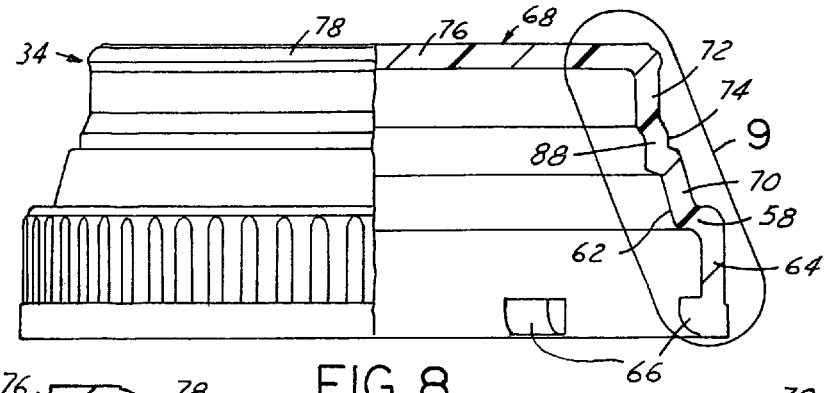
FIG. 8 is a partially sectioned elevational view of the closure in the package of FIGS. 1-3.
Figure 9:
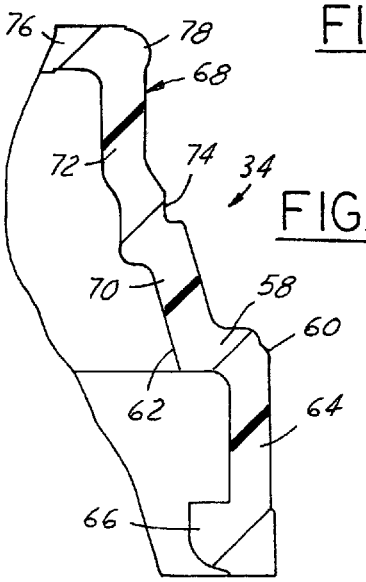
FIG. 9 is a fragmentary sectional view on an enlarged scale of the portion of FIG. 8 within the area 9.

Referring now to FIGS. 8-9, closure 34 includes an annular base wall 58. Base wall 58 preferably is flat, lying in a plane perpendicular to the axis of the closure, having concentric circular inner and outer peripheral edges 60, 62. A cylindrical skirt 64 extends from outer peripheral edge 60, and has a plurality of circumferentially spaced lugs 66 extending radially inwardly from the inner surface of the skirt in a plane spaced from base wall 58. A projection generally indicated at 68 extends from inner peripheral edge 62 of base wall 60 coaxially with skirt 64 and in an opposite direction from the skirt. Projection 68 may be either hollow, as shown, or solid. Projection 68 in the embodiment of FIGS. 8-9 includes a conical wall portion 70 contiguous with inner peripheral edge 62 of base wall 58, and a stepped annular wall portion 72 having a substantially cylindrical radially outwardly facing surface 74. An axially facing end wall 76 closes the end of wall 72, and preferably is flat for provision of suitable labeling or the like. It will be noted in FIG. 9 that the inner surface of conical wall portion 70 forms an extension from inner peripheral edge 62 of annular base wall 58, which is to say that inner peripheral edge 62 preferably is conical in construction, for purposes to be described. A circumferential bead 78 extends radially outwardly from wall portion 72 of closure projection 68 adjacent to end wall 76.

Figure 1:
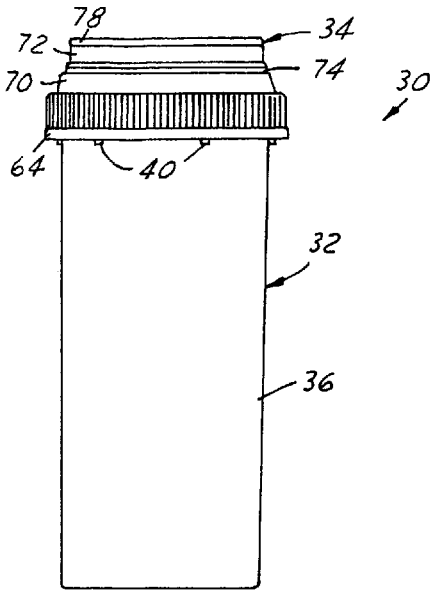
FIG. 1 is an elevational view of a closure and container package in accordance with one presently preferred embodiment of the invention in a child-resistant mode of operation.
Figure 2:
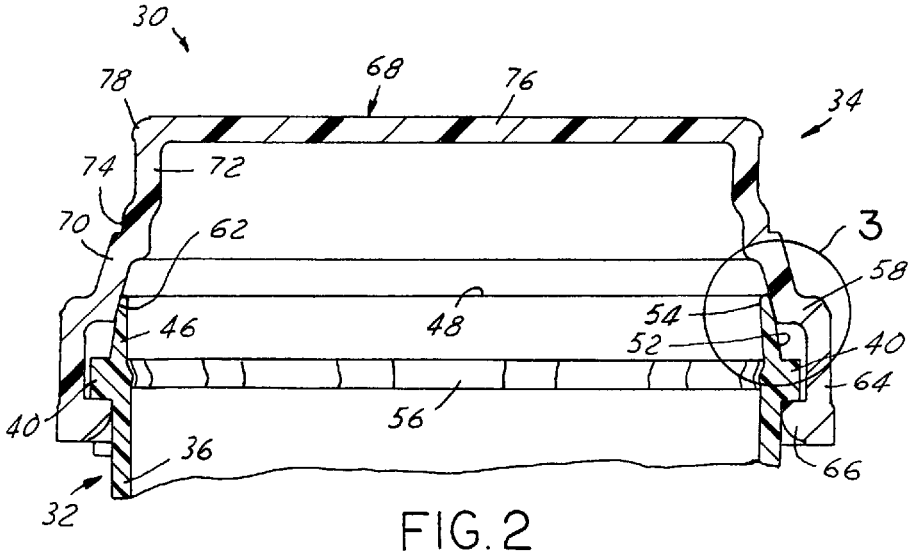
FIG. 2 is a fragmentary sectional view of the package illustrated in FIG. 1.
Figure 5:
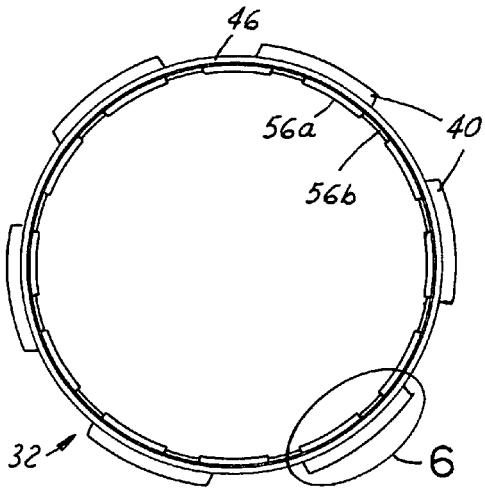
FIG. 5 is a top plan view of the container in FIG. 4.

In a child-resistant mode of operation illustrated in FIGS. 1-3, skirt 64 of closure 34 is received over the open end of container wall 36, and inner peripheral edge 62 of closure base wall 58 engages outer surface 52 of container wall portion 46. Continued downward movement of the closure with respect to the container flexes container wall portion 46 radially inwardly. Clockwise rotation of the closure on the container cams closure lugs 66 over surfaces 44 (FIG. 4) on container projections 40 until lugs 66 lock into projection notches 42. The angles of taper of closure base wall inner peripheral edge 62 and container wall surface 52, and the flexibility of container wall portion 46, preferably are such that there is full surface sealing engagement between edge 62 and surface 52, as best seen in FIG. 3, in the fully closed position of the closure on the container in the child-resistant mode of operation. Inner peripheral edge 62 of the closure base wall 58 thus cooperates with container wall portion 46 both to seal the package in the child-resistant mode of operation and resiliently to urge closure locking lugs 66 into container locking notches 42. To remove the closure, the closure is manually urged axially downwardly over the container against the force of wall portion 46 until the closure lugs clear the projection notches, and the closure is then turned counterclockwise.

Figure 11:
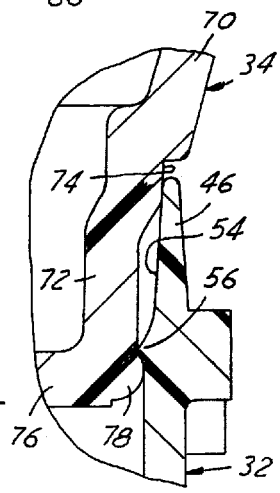
FIG. 11 is a fragmentary sectional view on an enlarged scale of the portion of FIG. 10 within the area 11.
Figure 10:
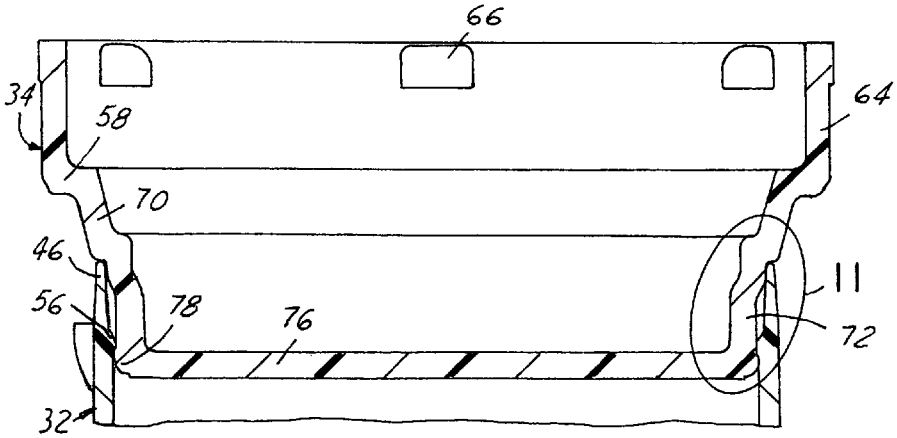
FIG. 10 is a fragmentary sectional view of the package of FIGS. 1-3 in a non-child-resistant mode of operation.

In the non-child-resistant mode of operation illustrated in FIGS. 10-11, closure 34 is inverted (as compared with FIGS. 1-3) and projection 68 is inserted into container mouth 50. Annular surface 74 is brought into engagement with inside surface 54 of container wall portion 46 for plug-sealing the closure within the container. In the meantime, bead 78 on closure 34 is received by snap fit over bead 56 on container 32 to secure the closure in the non-child-resistant position. Container wall portion 46 flexes radially outwardly upon engagement with closure wall surface 74 to enhance the sealing engagement between surfaces 74, 54.

FIGS. 12-28 illustrate packages, closures and containers in accordance with modified embodiments of the invention. Reference numerals in FIGS. 12-28 that are identical to those in FIGS. 1-11 indicate similar components. The descriptions of FIGS. 12-28 will concentrate primarily on differences as compared with FIGS. 1-11 and with each other.

Figure 12:
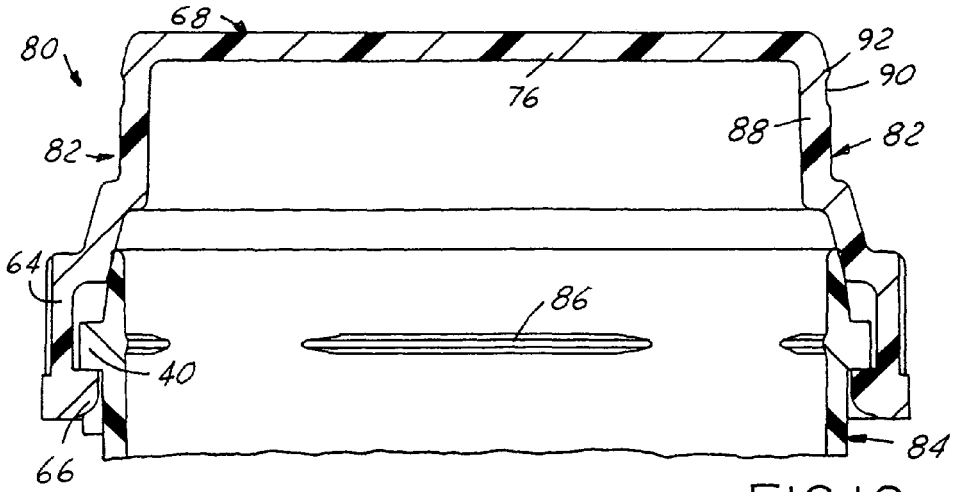
FIG. 12 is a fragmentary sectional view similar to that of FIG. 2 but showing a modified package in accordance with the invention in a child-resistant mode of operation.
Figure 13:
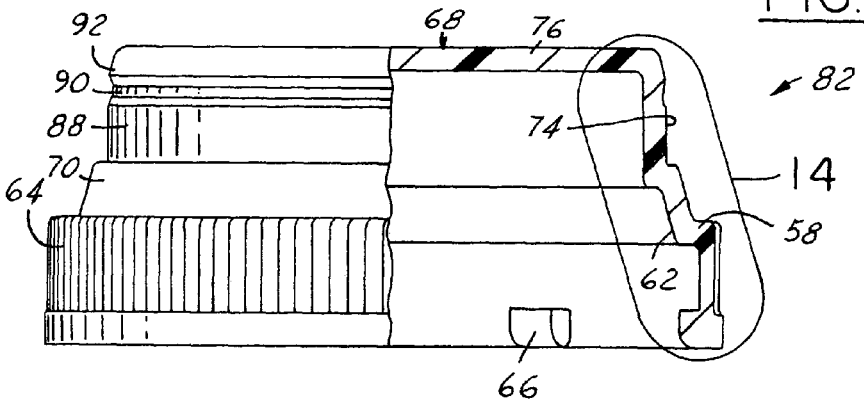
FIG. 13 is a partially sectioned elevational view similar to that of FIG. 8 but illustrating the closure in the package of FIG. 12.
Figure 14:
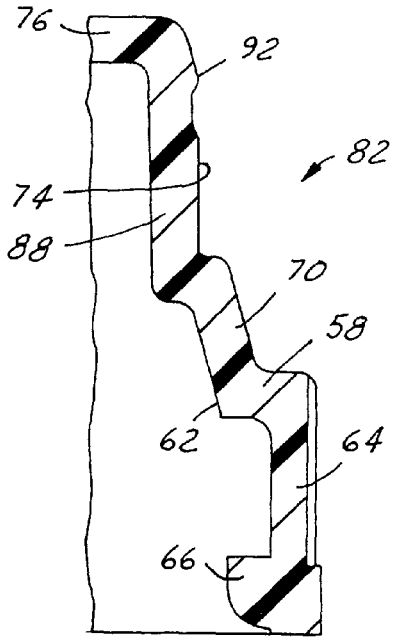
FIG. 14 is a fragmentary sectional view on an enlarged scale of the portion of FIG. 13 within the area 14.
Figure 15:
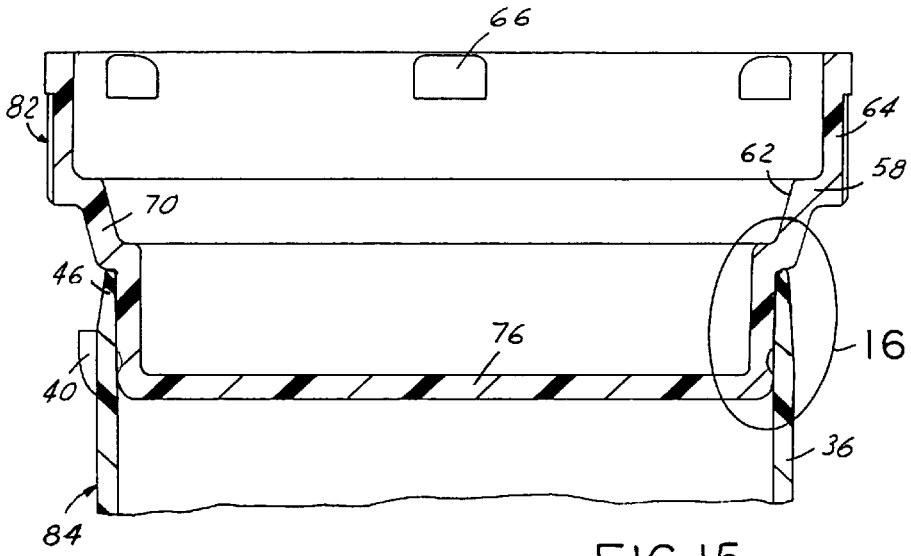
FIG. 15 is a fragmentary sectional view of the package in FIG. 12 in a non-child-resistant mode of operation.
Figure 16:
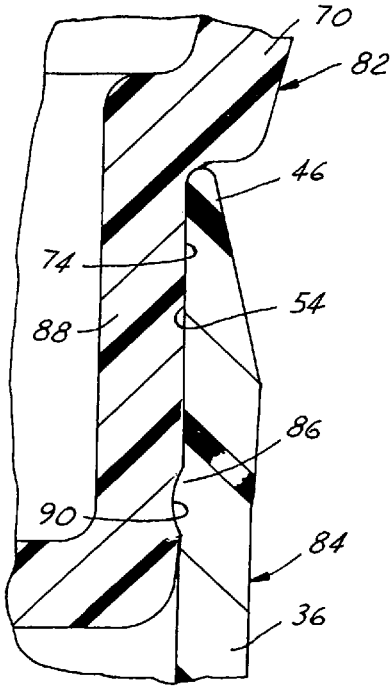
FIG. 16 is a fragmentary sectional view on an enlarged scale of the portion of FIG. 15 within the area 16.

FIGS. 12-16 illustrate a package 80 that includes a closure 82 mounted on a container 84 in a child-resistant mode of operation in FIG. 12, and in a non-child-resistant mode of operation in FIGS. 15 and 16. Container 84 is similar to container 32 discussed in detail above in connection with FIGS. 1-11, except that the bead for securing the closure to the container in the non-child-resistant mode of operation comprises a circumferentially segmented bead 86 (FIG. 12). Likewise, closure 82 in FIGS. 12-16 is similar to closure 34 in FIGS. 1-11, except that the annular wall 88 in closure 82 is a single cylindrical wall portion (ignoring draft angle), as distinguished from the stepped wall 72 in closure 34. In closure 82, projection 68 has a radially outwardly facing circumferential rib or bead 92 that is formed by an undercut 90 in annular wall 88. In assembly, this undercut 90 is received by snap fit over internal bead 86 on container 84 to secure the closure in position in the non-child-resistant mode of operation illustrated in FIGS. 15 and 16. Annular wall 88 of closure 82 has radially outwardly facing surface 74 in full sealing contact with radially inwardly facing surface 54 of container wall portion 46. Thus, once again, as in the embodiment of FIGS. 1-11, container wall portion 46 functions to seal the package in both the child-resistant and the non-child-resistant modes of operation, and resiliently captures the closure on the container in both modes of operation.

Figure 17:
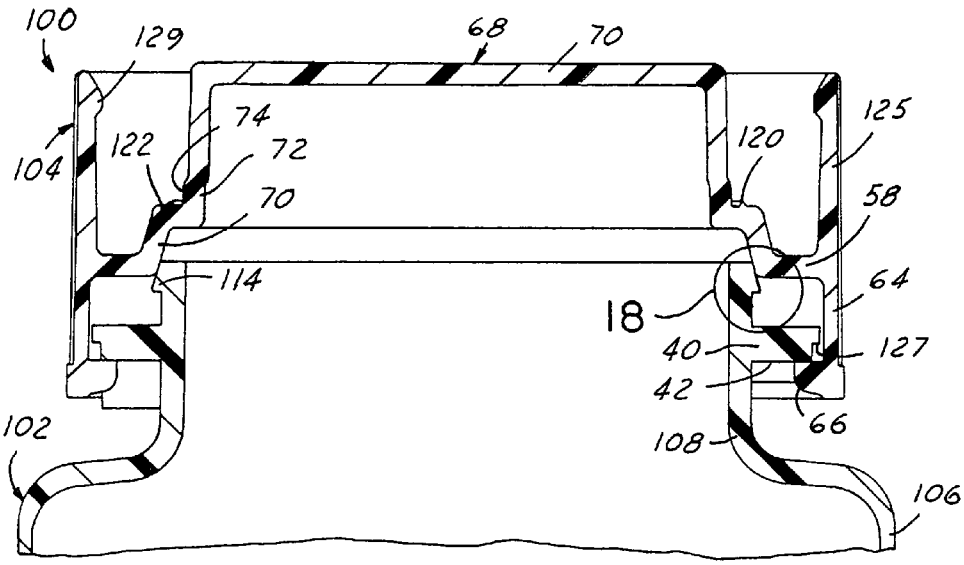
FIG. 17 is a fragmentary sectional view of a closure and container package in accordance with yet another embodiment of the invention in a child-resistant mode of operation.
Figure 18:
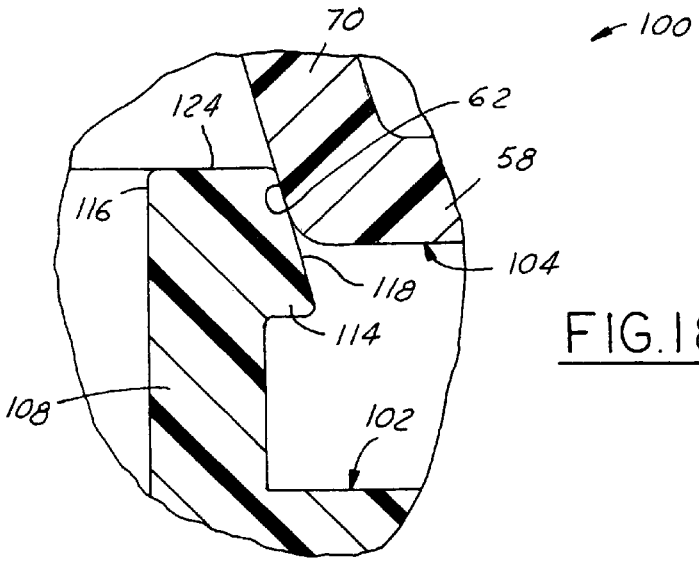
FIG. 18 is a fragmentary sectional view on an enlarged scale of the portion of FIG. 17 within the area 18.
Figure 19:
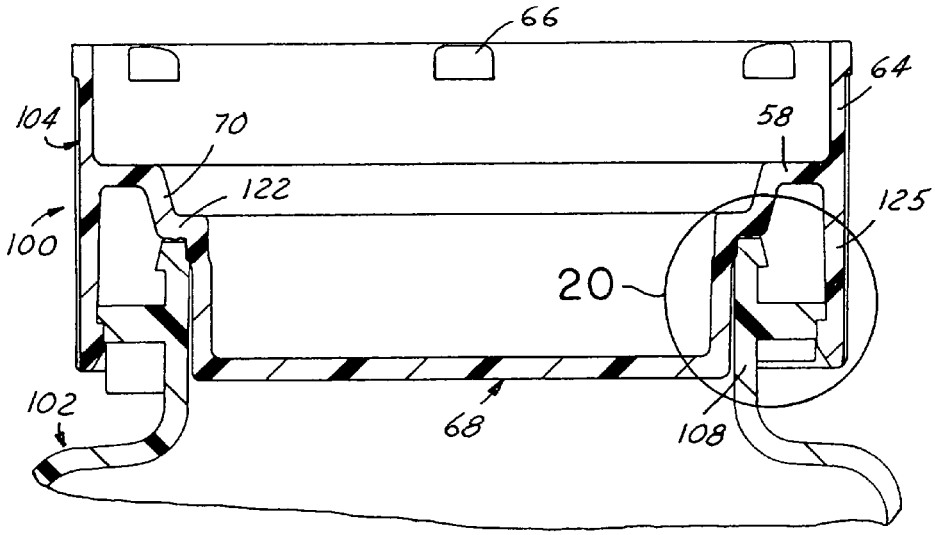
FIG. 19 is a fragmentary sectional view of the package of FIGS. 17-18 in a non-child-resistant mode of operation.
Figure 20:
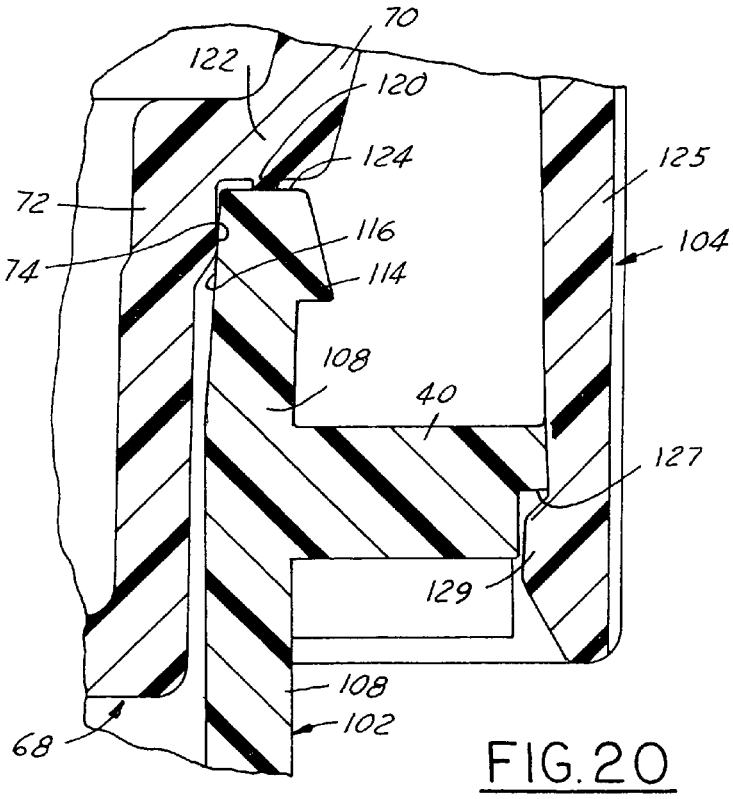
FIG. 20 is a fragmentary sectional view on an enlarged scale of the portion of FIG. 19 within the area 20.
Figure 21:
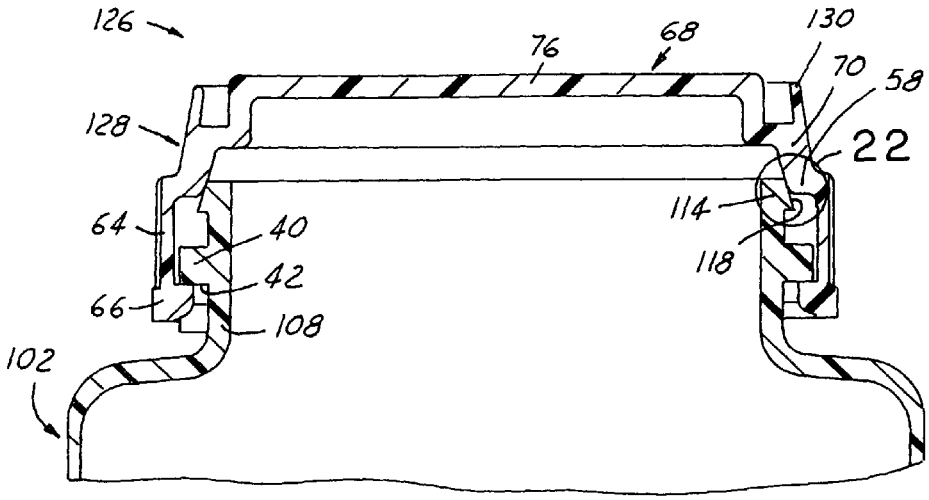
FIG. 21 is a fragmentary sectional view that illustrates a package in accordance with a further embodiment of the invention in a child-resistant mode of operation.
Figure 22:
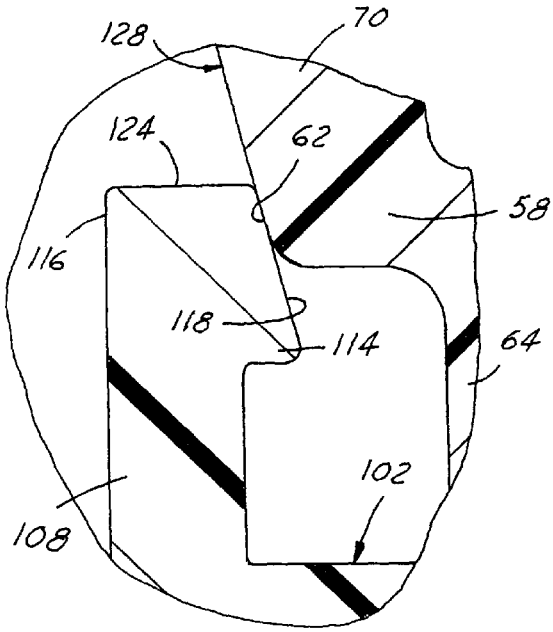
FIG. 22 is a fragmentary sectional view on an enlarged scale of the portion of FIG. 21 within the area 22.

FIGS. 17-20 illustrate a package 100 in accordance with a further embodiment of the invention in a child-resistant mode of operation (FIGS. 17-18) and a non-child-resistant mode of operation (FIGS. 19-20). Package 100 includes a container 102 and a closure 104. Container 102 is illustrated as including a body 106 having a cylindrical finish 108. (This same type of container may be employed in FIGS. 1-16, while the vial-type containers of FIGS. 1-16 can be employed in the packages of FIGS. 17-24.) A circumferential array of projections 40 extend radially outwardly from finish 108, and have notches 42 for capturing closure 104 in the child-resistant mode of operation (FIGS. 17-18). An external rib or bead 114 extends circumferentially around the upper edge of container finish 108 surrounding container mouth 116. Bead 114 serves to thicken and rigidify the upper end of the container finish. Bead 114 has an axially facing outer surface 124 and a radially outwardly facing surface 118 that is conical in geometry, narrowing axially toward surface 124 and the open mouth of the container.

Closure 104 includes annular base wall 58 having an outer peripheral edge from which cylindrical skirt 64 extends. Lugs 66 extend radially inwardly from skirt 64 for capture within notches 42 on lugs 40. Conical wall 70 extends from inner peripheral edge 62 of base wall 58, forming a conical surface extension of the inner peripheral edge of the base wall, as discussed in detail above in connection with FIGS. 1-11. Thus, as in the previous embodiments, inner peripheral edge 62 of base wall 58 cooperates with external surface 118 surrounding the container mouth both for sealing the package and for resiliently capturing the closure on the container in the child-resistant mode of operation. However, in the embodiment of FIGS. 17-20 (and the embodiment of FIGS. 21-24), the resiliency for biasing the closure to the locked position is provided by outward flexure of closure base wall 58 rather than inward flexure of container finish 108, which is strengthened and rigidified by bead 114.

Projection 68 of closure 104 has annular wall 72 with a radially outwardly facing surface 74. An annular seal bead 120 is disposed on a step 122 of projection 68 for axial abutting engagement with outer end surface 124 of container finish 108 in the non-child-resistant mode of operation (FIGS. 19 and 20). Surface 74 of wall 72 is in plug-sealing engagement within mouth 116 of container finish 108, as in the prior embodiments. A cylindrical wall 125 extends from the outer peripheral edge of base wall 58 as an axial extension of closure skirt 64 and radially outwardly surrounding projection 68. Each projection 40 on container finish 108 has a downwardly facing ledge 127, with the ledges 127 of the several projections 40 lying in a plane perpendicular to the axis of the container finish. Closure wall 125 has a radially inwardly extending circumferential bead 129 that is received by snap fit over ledges 127 of the several projections 40 to secure closure 104 in inverted position (FIGS. 19 and 20) in the non-child-resistant mode of operation.

FIGS. 21-24 illustrate a closure and container package 126 in child-resistant (FIGS. 21-22) and non-child-resistant (FIGS. 23-24) modes of operation. Package 126 includes a container 102 that is substantially the same as container 102 in FIGS. 17-20 but need not include projection shoulders 127, and a closure 128 secured to the container. Closure 128 includes annular base wall 58 with outer peripheral skirt 64 and lugs 66 for receipt in notches 42 of projections 40 on container finish 108. Closure 128 also includes a conical wall 70 that extends from inner peripheral edge 62 of closure base wall 58, forming a continuous conical surface that cooperates with conical surface 118 of a strengthening bead 114 around the container mouth. Thus, as in the embodiment of FIGS.

Figure 23:
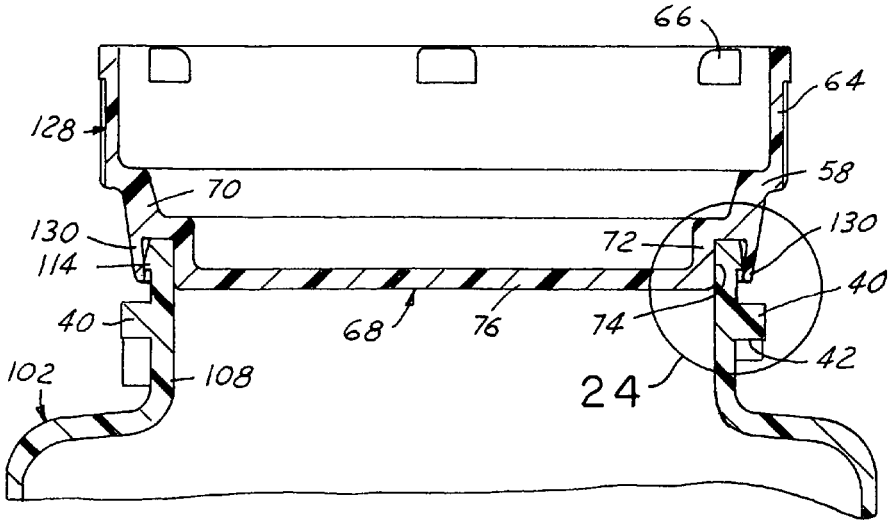
FIG. 23 is a fragmentary sectional view of the package of FIGS. 21-22 in a non-child-resistant mode of operation.
Figure 24:
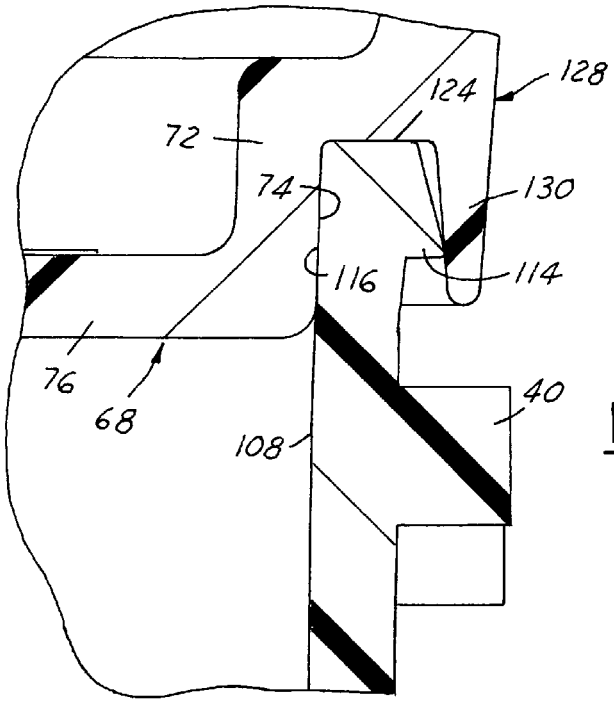
FIG. 24 is a fragmentary sectional view on an enlarged scale of the portion of FIG. 23 within the area 24.

17-20, closure base wall 58 cooperates with surface 118 on strengthening bead 114 both to seal the package in the child-resistant mode of operation (FIGS. 21-22) and to urge locking lugs 66 into locking engagement with container finish projections 40. Projection 68 of closure 128 includes annular wall 72 with radially outwardly facing surface 74 that abuts the radially inwardly facing surface of container finish 108 in the non-child-resistant mode of operation (FIGS. 23-24). There is also axial abutment between opposed surfaces of the container and closure in the non-child-resistant mode of operation for additional sealing integrity. A seal bead may be provided on closure 128, such as seal bead 120 in the embodiment of FIGS. 17-20. A circumferentially continuous flexible resilient lip or wall 130 extends around closure 128 radially outwardly spaced from surface 74 of projection wall 72 for interference fit over bead 114 on container finish 108 removably to capture closure 128 on container 102 in the non-child-resistant mode of operation (FIGS. 23-24).

Figure 25:
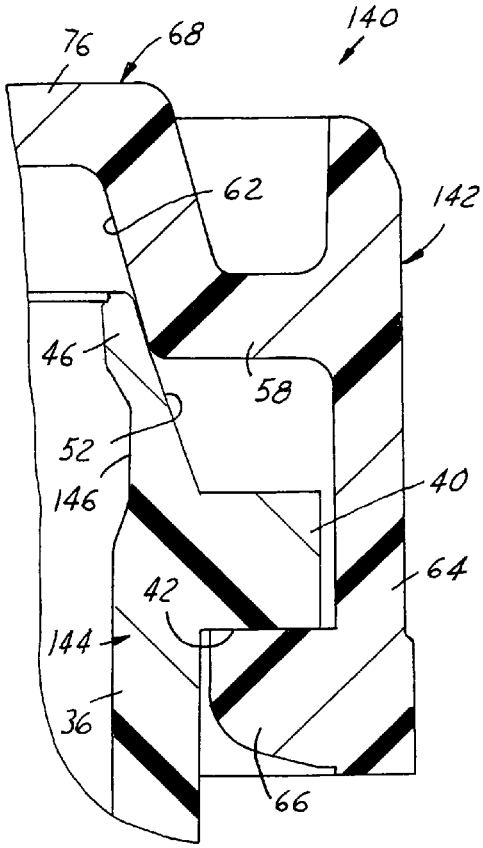
FIGS. 25 and 26 are fragmentary sectional views of respective additional embodiments of the invention.

FIG. 25 illustrates a child-resistant package 140 that includes a closure 142 and a container 144. An undercut or channel 146 extends circumferentially around the inside surface of container wall 36 to facilitate inward flexure of upper wall portion 46. Undercut or channel 146 in FIG. 25 is radially inward from the upper surfaces of projections 42. Thus, as in the embodiments of FIGS. 1-16, the resilient forces that provide child-resistance come from inward flexure of wall portion 46 in FIG. 25.

Figure 26:
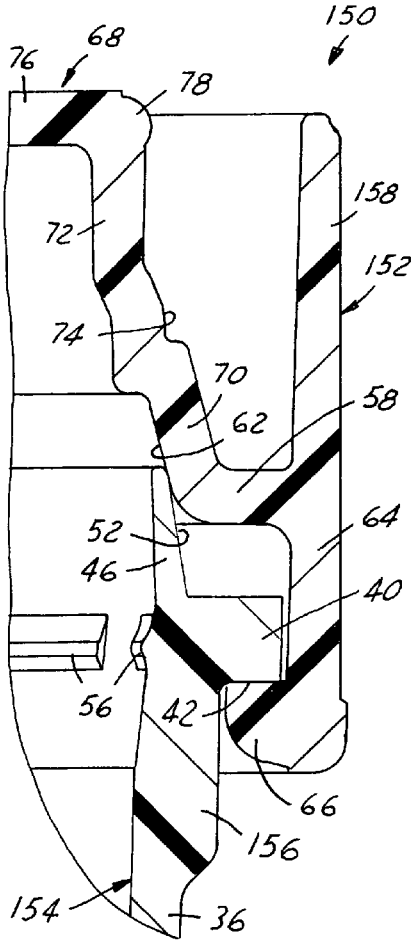

FIG. 26 illustrates a package 150 that includes a closure 152 and a container 154. Container 154 is similar to container 32 in FIGS. 1-6, except that projections 40 are provided on an external ledge 156 that extends radially outwardly from wall 36 entirely around the container. Ledge 156 facilitates pick up of container 154 by automated filling apparatus, and thus makes package 150 more automation friendly. Closure 152 is similar to closure 34 in FIGS. 1-3 and 8-11, except that an outer wall 158 is provided around projection 68. Outer wall 158 is an axial extension of skirt 64, and serves to hide projections 40 when closure 152 is assembled to container 154 in a non-child-resistant mode of operation.

Figure 27:
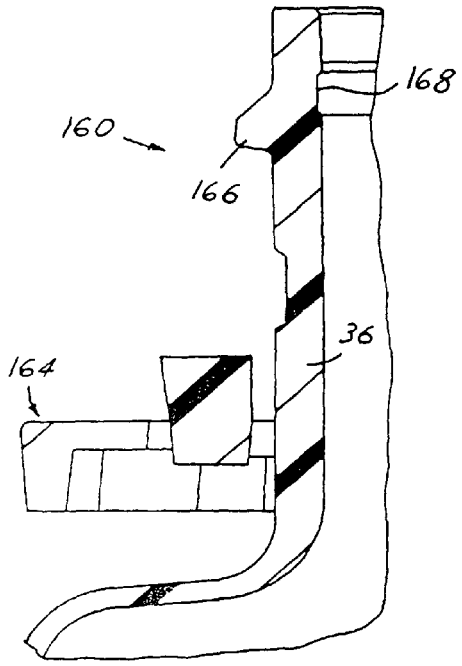
FIGS. 27 and 28 are respective fragmentary sectional views of a container and a closure in accordance with another embodiment of the invention.
Figure 28:
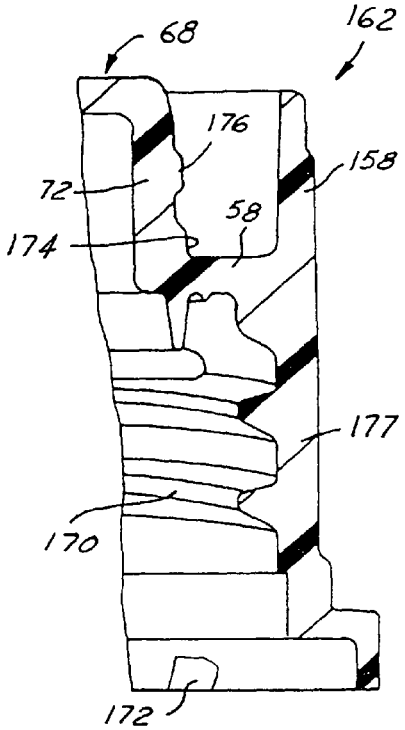

FIGS. 27 and 28 respectively illustrate a container 160 and a closure 162 in accordance with another embodiment of the invention. Container 160 (FIG. 27) has a finish wall 36 from which a child-resistant element 164 projects. Element 164 is as disclosed in U.S. Pat. No. 5,899,348. Finish wall 36 has one or more external threads 166 and an internal circumferential groove or channel 168 adjacent the open end of the finish. Closure 162 (FIG. 28) has a skirt 168 with one or more internal threads 170 and an internal lug 172 for cooperation with container element 164 (FIG. 27) as taught by the above-noted patent. Projection 68 extends from the inner periphery of base wall 58. Sidewall 72 of projection 68 has a conical external surface 174 adjacent to the base wall, and has a circumferentially continuous or segmented external bead 176 spaced from the base wall. In the child-resistant mode of operation, the package of container 160 and closure 162 operates as in the above-noted patent. In the non-child-resistant mode of operation, projection 68 is received within the mouth of the container. Bead 176 on closure projection 68 is received by snap fit within channel 166 in container wall 36. Closure surface 174 is in plug sealing engagement with the inside diameter of the container mouth.

There have thus been disclosed a closure and container package, a closure, a container, and a method of making a closure and container package that fully satisfy all of the objects and aims previously set forth. The invention has been disclosed in conjunction with a number of presently preferred embodiments, and additional modifications and variations have also been described. Other modifications and variations will readily suggest themselves to persons of ordinary skill in the art. The invention is intended to embrace all such modifications and variations as fall within the spirit and broad scope of the appended claims.

The invention claimed is:

1. A package having child-resistant and non-child-resistant modes of operation, which includes:

a container having an end with an open mouth surrounded by a container wall with a central axis and an outer surface surrounding said mouth, and at least one first lock element extending radially outwardly from said wall, and a closure that includes an annular base wall having inner and outer peripheral edges, a cylindrical skirt extending from said outer peripheral edge of said base wall, at least one second lock element on said skirt, and a projection extending axially from said inner peripheral edge of said base wall in a direction opposite from said skirt, said projection having an annular sidewall spaced radially inwardly from said outer peripheral edge of said skirt, said closure being adapted to be secured to said container in a child-resistant mode of operation with said at least one second lock element on said skirt releasably engaged with said at least one first lock element on said container wall, and with said inner peripheral edge of said base wall in engagement with said outer surface of said container wall to bias said lock elements in engagement with each other and to seal said package, said closure being adapted to be secured to said container in a non-child-resistant mode of operation with said annular sidewall of said projection received in plug-sealing engagement within said container mouth, said closure including a wall extending from said outer peripheral edge of said base wall, said wall being of sufficient length to radially outwardly cover said at least one first lock element on said container by extending axially below said at least one first lock element when said projection is received within the container mouth, said container wall being radially resiliently flexible around said mouth, flexing radially inwardly from engagement with said inner peripheral edge of said base wall in said child-resistant mode of operation and radially outwardly from engagement with said annular wall in said non-child-resistant mode of operation, said container including an internal channel in said container wall adjacent to an end of said container wall to facilitate inward flexure of said wall around said mouth.

2. The package set forth in claim 1 wherein said base wall is flat lying in a plane between said inner and outer peripheral edges, and wherein said inner and outer peripheral edges are circular and concentric.

3. The package set forth in claim 1 wherein said container wall tapers in radial thickness surrounding said mouth.

4. A package having child-resistant and non-child-resistant modes of operation, which includes:

a container having an end with an open mouth surrounded by a container wall with a central axis and an outer surface surrounding said mouth, and at least one first lock element extending radially outwardly from said wall, and a closure that includes an annular base wall having inner; and outer peripheral edges, a cylindrical skirt extending from said outer peripheral edge of said base wall, at least one second lock element on said skirt, and a projection extending axially from said inner peripheral edge of said base wall in a direction opposite from said skirt, said projection having an annular sidewall spaced radially inwardly from said outer peripheral edge of said skirt, said closure being adapted to be secured to said container in a child-resistant mode of operation with said at least one second lock element on said skirt releasably engaged with said at least one first lock element on said container wall, and with said inner peripheral edge of said base wall in engagement with said outer surface of said container wall to bias said lock elements in engagement with each other and to seal said package, said closure being adapted to be secured to said container in a non-child-resistant mode of operation with said annular sidewall of said projection received in plug-sealing engagement within said container mouth, said closure including a wall extending from said outer peripheral edge of said base wall, said wall being of sufficient length to radially outwardly cover said at least one first lock element on said container by extending axially below said at least one first lock element when said projection is received within the container mouth, said container wall being radially inflexible around said mouth, and said closure being adapted to flex radially outwardly around said base wall for urging said second lock element against said first lock element, said wall of said container wall including a radially outwardly extending external bead surrounding said mouth and stiffening said container wall against radial flexure around said mouth, said bead having a conical outer surface for engagement by said inner peripheral edge of said base wall in said child-resistant mode of operation to flex said base wall radially outwardly.

5. The package set forth in claim 4 wherein said closure includes a flexible resilient wall spaced radially outwardly from said annular wall of said projection for resiliently embracing said bead on said container wall in said non-child-resistant mode of operation.

6. A package having child-resistant and non-child-resistant modes of operation, which includes:

a container having an end with an open mouth surrounded by a container wall with a central axis and an outer surface surrounding said mouth, and at least one first lock element extending radially outwardly from said wall, and a closure that includes an annular base wall having inner and outer peripheral edges, a cylindrical skirt extending from said outer peripheral edge of said base wall, at least one second lock element on said skirt, and a projection extending axially from said inner peripheral edge of said base wall in a direction opposite from said skirt, said projection having an annular sidewall spaced radially inwardly from said outer peripheral edge of said skirt, said closure being adapted to be secured to said container in a child-resistant mode of operation with said at least one second lock element on said skirt releasably engaged with said at least one first lock element on said container wall, and with said inner peripheral edge of said base wall in engagement with said outer surface of said container wall to bias said lock elements in engagement with each other and to seal said package, said closure being adapted to be secured to said container in a non-child-resistant mode of operation with said annular sidewall of said projection received in plug-sealing engagement within said container mouth, said closure including a wall extending from said outer peripheral edge of said base wall, said wall being of sufficient length to radially outwardly cover said at least one first lock element on said container by extending at least axially even with said at least one first lock element when said projection is received within the container mouth, wherein said wall extends from said outer peripheral edge of said base wall in a direction opposite from said skirt for engaging said at least one first lock element on said container in said non-child-resistant mode of operation.

7. The package set forth in claim 6 wherein said at least one first lock element includes a plurality of projections on said container wall, said projections having shoulders in a common plane, and wherein said wall extending from said outer peripheral edge has an internal bead for engagement over said shoulders in said non-child-resistant mode of operation.

8. A package having child-resistant and non-child-resistant modes of operation, which includes:

a container having an end with an open mouth surrounded by a container wall with a central axis and an outer surface surrounding said mouth, and at least one first lock element extending radially outwardly from said wall, and a closure that includes an annular base wall having inner and outer peripheral edges, a cylindrical skirt extending from said outer peripheral edge of said base wall, at least one second lock element on said skirt, and a projection extending axially from said inner peripheral edge of said base wall in a direction opposite from said skirt, said projection having an annular sidewall spaced radially inwardly from said outer peripheral edge of said skirt, said closure being adapted to be secured to said container in a child-resistant mode of operation with said at least one second lock element on said skirt releasably engaged with said at least one first lock element on said container wall, and with said inner peripheral edge of said base wall in engagement with said outer surface of said container wall to bias said lock elements in engagement with each other and to seal said package, said closure being adapted to be secured to said container in a non-child-resistant mode of operation with said annular sidewall of said projection received in plug-sealing engagement within said container mouth, said closure including a wall extending from said outer peripheral edge of said base wall, said wall being of sufficient length to radially outwardly cover said at least one first lock element on said container by extending axially below said at least one first lock element when said projection is received within the container mouth.

* * * * *